United States Patent [19]

Mohr

[11] 4,098,309

[45] Jul. 4, 1978

[54] FUEL CONTAINER WITH FILLING VALVE

[75] Inventor: Walter Mohr, Frankfurt am Main, Germany

[73] Assignee: Braun AG, Frankfurt am Main, Germany

[21] Appl. No.: 700,778

[22] Filed: Jun. 29, 1976

[30] Foreign Application Priority Data

Sep. 27, 1975 [DE] Fed. Rep. of Germany ..... 2543255

[51] Int. Cl.[2] ..... B65B 1/04

[52] U.S. Cl. ..... 141/291; 141/18; 141/348; 431/344

[58] Field of Search ..... 141/301, 292, 291, 348, 141/349, 18; 431/344, 255

[56] References Cited

U.S. PATENT DOCUMENTS

| | | | |
|---|---|---|---|
| 2,881,810 | 4/1959 | Breitenstein | 141/349 X |
| 2,989,091 | 6/1961 | Lowenthal | 141/349 X |
| 3,228,435 | 1/1966 | Kanamaru | 141/291 X |
| 3,307,595 | 3/1967 | Berning et al. | 141/348 X |
| 3,373,776 | 3/1968 | Kajita | 141/292 X |
| 3,521,999 | 7/1970 | Gauck | 141/291 X |
| 3,859,037 | 1/1975 | Mohr | 431/344 |

*Primary Examiner*—Edward G. Favors
*Attorney, Agent, or Firm*—Karl F. Ross

[57] ABSTRACT

A fuel container with a filling valve, especially for a refillable cigarette or cigar lighter, comprises a partition or shield surrounding the movable valve member and provided with a small-section orifice to prevent entry of fibrous material which may block self-closure of the valve.

9 Claims, 5 Drawing Figures

FUEL CONTAINER WITH FILLING VALVE

FIELD OF THE INVENTION

The present invention relates to fuel containers provided with a filling valve of the type which is intended to close to prevent escape of the fuel once the container is charged. More particularly, the invention relates to nondisposable (refillable) cigarette and cigar lighters of the type in which a spring-loaded valve member is displaced during filling to allow entry of the fuel and automatically is seated against a sealing surface to block escape thereof upon withdrawal of the filling nozzle from the filling opening.

BACKGROUND OF THE INVENTION

While various fuel containers are provided with self-closing filling valves, such valves are most frequently encountered with cigarette and cigar lighters, other than disposable lighters, which may require filling with a fuel such as butane from a vessel or tank having a nozzle which can be inserted into the filling opening. The valve is unblocked during such filling and automatically closes upon withdrawal of the nozzle and completion of the filling operation, generally under spring pressure, to prevent escape of the fuel.

Filling valves for cigarette lighters and the like are known in a variety of configurations, but generally comprise a valve body which is biased by spring pressure against a sealing surface around the filling opening. The valve body thus has one sealing surface while the filling opening is surrounded by a second annular sealing surface, the two surfaces abutting to prevent escape of the fuel. In some cases one or both of the sealing surfaces are provided with a sealing washer, ring or disk. One or the other of the sealing surfaces may also be provided with a sharp edge adapted to engage with practically line contact the opposite sealing surface. Thus a sharp-edge sealing surface may be formed around the filling opening for engagement with the valve member.

In practice it has been found that contaminants may appear on one or both of the sealing surfaces and may hold the valve partially open with the effect that the fuel escapes, especially since the foreign matter or contaminant is frequently a fibrous material which may derive from the wick which is customarily associated with the burner valve and extends into the fuel within the tank, or from the envelope, bag or other porous enclosure of an adsorption agent which can be placed in the tank in order to pick up oils or fatty substances which may be present in the fuel.

OBJECT OF THE INVENTION

It is the object of the present invention to provide, in a fuel tank structure of the aforedescribed type, and particularly in an improved cigarette lighter, a filling valve structure free from the abovementioned disadvantages and thus less prone to disruption by contaminants.

SUMMARY OF THE INVENTION

This object and others which will become apparent hereinafter are attained, in accordance with the present invention, by surrounding the valve or at least a portion thereof forming the sealing surfaces and projecting into the container, with a partition which is disposed between the fuel-receiving space of the tank or fuel and the valve surfaces, the partition being provided with one or more throughgoing passages and obstructing the passage of foreign matter toward the sealing surfaces.

Especially with fuel containers made by casting, die-casting or injection-molding processes, the valve-receiving container wall and the partition can be fabricated unitarily and monolithically, i.e. in a single piece.

According to another feature of the invention, the partition is mounted upon the container wall, e.g. by adhesive bonding, thermal welding or a screw-thread arrangement. Preferably the partition is a pot-shaped structure and is axially elongated, projecting into the interior of the fuel container.

The end of the partition within the container is preferably generally conical or tapered i.e. formed by a conical or frustoconical tip, thereby deflecting contaminants, which may settle toward the valve, away from the latter. The tip can be formed with throughgoing passages, at least one of which is provided axially at the apex of the tip. The valve structure itself (and especially the movable valve member and its spring) is then advantageously located in the concavity or interior of the pot-shaped partition structure.

According to a preferred embodiment of the invention, the pot-shaped partition serves as a housing for all of the valve parts, namely, the movable valve body, the valve-closing spring, seals and mounting elements. The housing structure previously required for the filling valve can then be eliminated since the function of such housing is taken over by the partition at a substantial reduction in cost of the filling valves.

I have found that the passages should have circular cross sections and diameters of 0.2 mm to 0.8 mm, this being an important feature of the invention. The number of passages provided in the partition and the diameter thereof can be related to one another in the sense that the more passages that are provided, the smaller the diameter of each. While diameters within the range indicated appear to completely exclude the usual contaminants and foreign matter which tend to disrupt operation of the valve, diameters at the lower end of the range can be used when a multiplicity of passages are provided. When only a single passage is used the diameter is preferably 0.5 mm while diameters below 0.5 mm can be used when a greater number of passages are provided.

The total flow cross section of all passages should be at least, according to the invention, approximately 0.2 $mm^2$, corresponding to a circular passage of a diameter of 0.5 mm. The minimum number of passages of any given diameter to provide this minimum flow cross section can be easily calculated once the passage diameter is determined.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
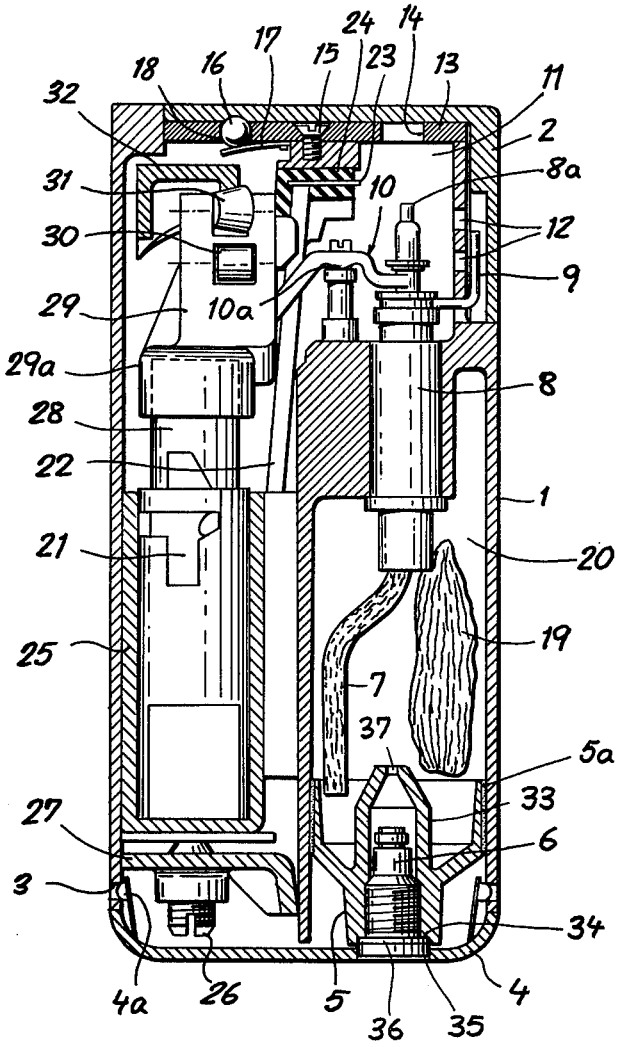
FIG. 1 is a vertical section through a pocket lighter according to the present invention, parts being shown in elevation and diagrammatically.
Figure 3:
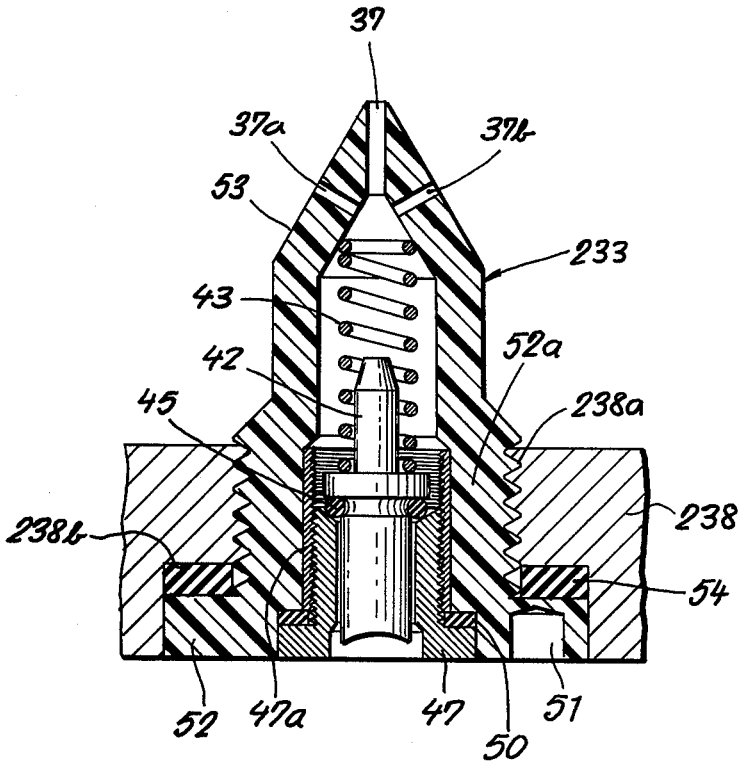
FIG. 3 is a section through another embodiment of the invention.
Figure 5:
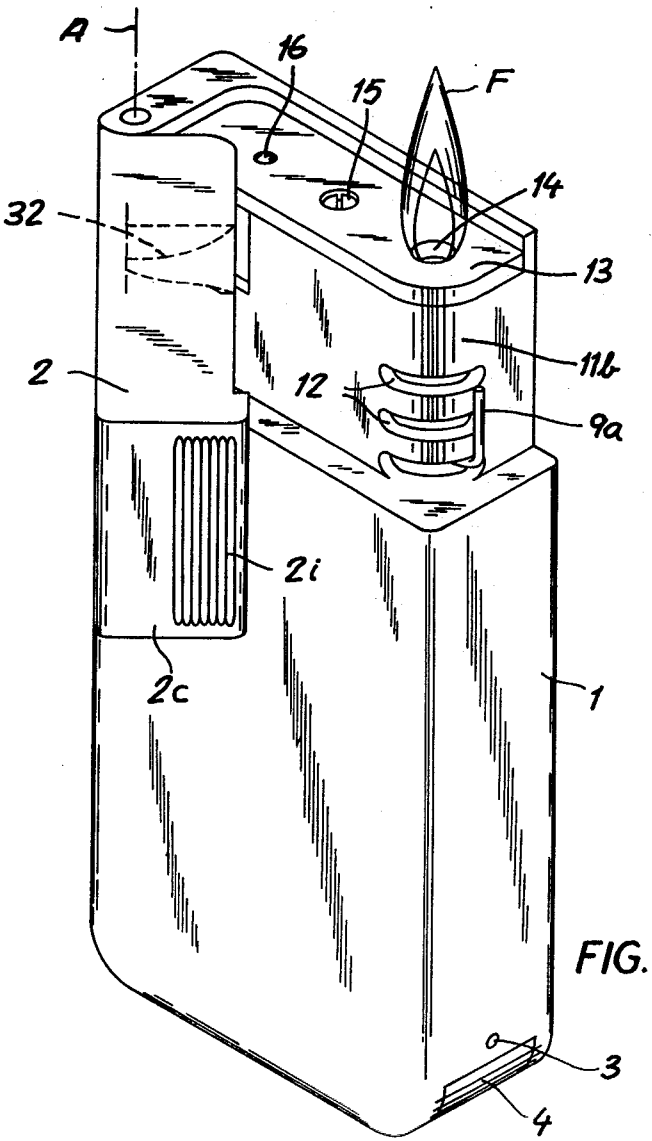
FIG. 5 is a perspective view, partly broken away, of the lighter in its actuated position.
Figure 4:
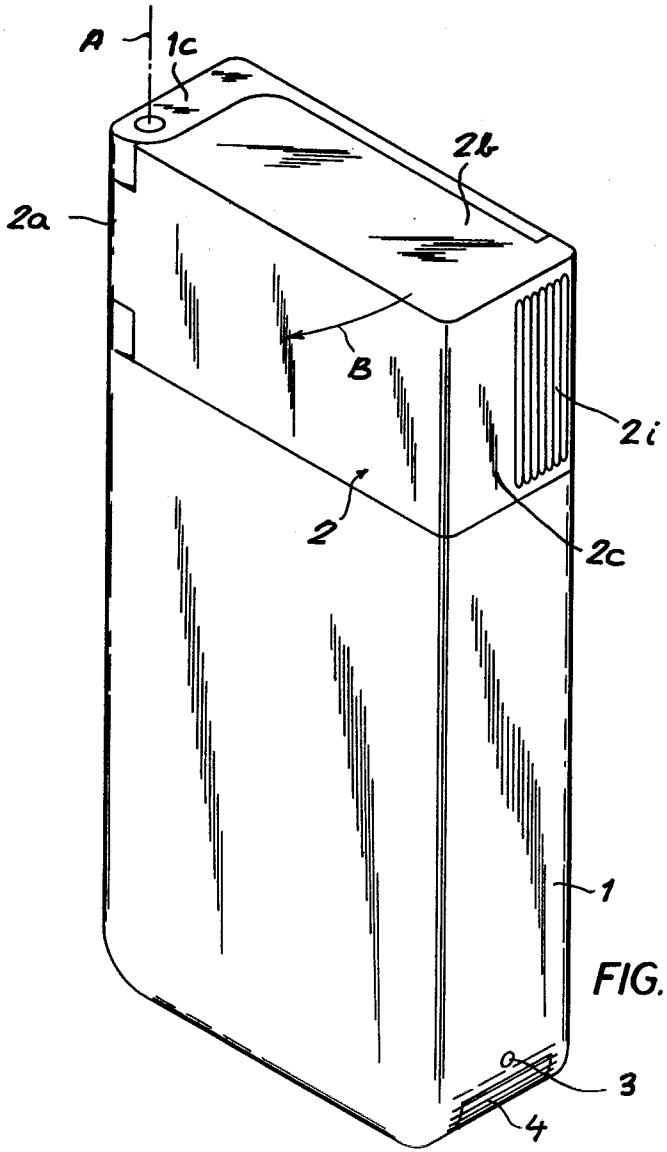
FIG. 4 is a perspective view of the lighter in an unactuated position.

In FIG. 1 show a lighter housing 1 having an actuator member 2 hinged at 2a to the housing 1 for swinging movement about a pivot axis A (FIG. 5) from the position of the actuator 2 shown in FIG. 4. The bottom 4 of the housing has tongues 4a which snap into openings 3 along the bottom of housing 1. The housing 1 defines a fuel tank 20 having a tank bottom 5 which can be sealed adhesively as represented at 5a within the housing 1 and is provided with a filling valve 6 which can be of the type shown in either FIG. 2 or FIG. 3.

A wick 7 extends into the fuel compartment 20 from a burner valve 8 which has a flame-height adjustment device 9. The latter can be of the type described in U.S. Pat. No. 3,859,035.

The burner valve lever 10, which has one arm engaged with a body 29 and its other arm with the movable portion of the valve 8 to open the latter in the manner described in U.S. Pat. No. 3,859,035, is swingably mounted at 10a in the housing 1. A jet of gas thus emerges from the orifice 8a of the burner 8 and can be ignited to form a flame F (FIG. 5) which can pass through an opening 14 in a cover 13 attached by a screw 15 to the housing 1.

The space 11 surrounding the burner orifice 8a is defined by a wall 1b (FIG. 5) which is formed with perforations 12 to vent the space 11 and supply atmospheric oxygen thereto for mixture with the fuel gas to sustain the combustion.

An indexing ball 16, movable in an opening 18 of the plate 13 is biased upwardly by a plate spring 17 which is received in a recess of housing 1 and is anchored therein.

To prevent oily and fatty contaminants of the fuel from entering the burner valve and detrimentally affecting its operation, the fuel compartment 20 is provided with an envelope or sack of gas-permeable material for receiving an adsorption agent of the type described in U.S. Pat. No. 3,859,037.

An electric igniter 21, which can be of the type described in U.S. Pat. Nos. 3,898,534 or 3,936,678, with latching of the hammer in its starting position, is mounted in the housing 1. The piezoelectric igniter 21 is connected by a conductor 22 with an electrode 23 received in an insulating body 24 and projecting into the chamber 11. The second electrode is formed by the tip 8a of the burner valve 8 which is electrically connected to the case of the piezoelectric igniter.

The fixed part of the piezoelectric igniter 21 is surrounded by a sleeve 25 upon which a setscrew 26 bears to raise and lower the igniter with respect to the actuator arrangement 29 etc., described hereinafter. The setscrew 26 is threaded into a plate 27 fixed in the housing 1 and internally threaded to receive the setscrew.

The piezoelectric igniter 21 also has a rectilinearly slidable part 28 onto which is fitted the cap 29a of a body 29 of a force-transmitting mechanism having a roller 30 adapted to ride against a wall (not shown) of the housing 1 to minimize frictional resistance to the vertical displacement of this member 29. Member 29 also carries a frustoconical roller 31 on which rides a curvedtrack cam 32 fixed to the actuator 2.

Thus, when the actuator 2 is swung from its position illustrated in FIG. 4 in a clockwise sense (arrow 30) about the axis A, the cam 32 swings about this axis and urges the follower roller 31 downwardly, thereby pressing member 29 downwardly to drive member 28 of the igniter 21 into the stationary part of the igniter. During this downward movement, lever 10 opens the burner valve and, when the hammer of the igniter is tripped, a spark is developed between electrode 23 and the burner tip 8a to ignite the flame F.

The tank bottom 5, shown in FIG. 1 to be adhesively bonded at 5a to the wall of housing 1, can, of course, also be thermally welded thereto, especially if members 1 and 5 are formed from thermally fusible synthetic-resin materials.

The tank bottom 5 is provided with a pot-shaped axially elongated partition 33 extending into the fuel tank 20 and formed in a single piece with the tank bottom 5. A complete filling valve 6 is threaded into the pot-shaped partition 33 and has an annular shoulder 34 and another annular shoulder 35 comprising between them a seal 36 to form the valve. The partition is provided with a passage 37 through which the fuel can pass into the tank 20. The passage 37 has a diameter of 0.5 mm.

Figure 2:
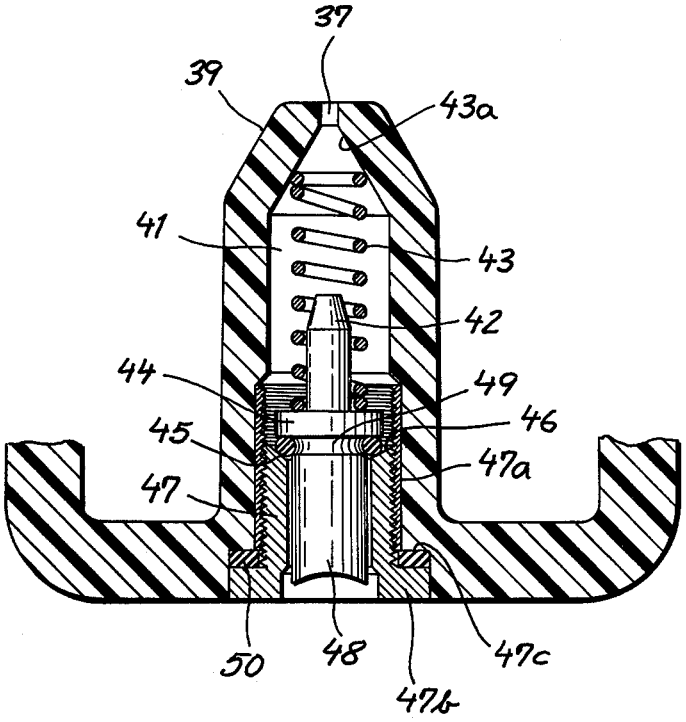
FIG. 2 is a section through a filling valve for the lighter of FIG. 1 according to the invention.

FIG. 2 shows an embodiment of the partition wall and valve structure in which the partition wall 133 is formed unitarily with the bottom 138 of the housing 101 of the lighter. At its upper end the partition wall is provided with a frustoconical tip 39 with the centrally disposed passage 37.

In the embodiments of FIGS. 2 and 3, the reference numerals which are used to the extent that they are identical to those of FIG. 1, represent identical structure. Similarly functioning but structurally different elements use the same reference numerals differing by the hundreds' digit.

In the interior 41 of the pot shaped partition 33, I provide a movable valve member 42 with an annular flange 44 against which a coil spring 43 acts. The coil spring 43 is fitted at 43a in the tip 39 of the partition 133. The spring 43 thus urges the flange 44 against seal 45 which can be an O-ring held against a frustoconical seat 46 forming the inner end of a tubular member 47. A pin 48 of the valve member projects through the sleeve 47 for engagement with the nozzle of a filling tank which, when pressed against this pin 48, moves the flange 44 and the O-ring 45 away from the seat 46 to permit the fuel to enter the lighter. The O-ring 45 is received in a groove 49 formed in the pin 48.

An internally threaded sleeve 47a may be embedded in the partition 133 during the fabrication thereof so that the externally threaded sleeve 47 can be screwed into this partition 33. A sealing ring 50 is clamped between the head 47b of this sleeve and a shoulder 47c is recessed in the wall 138 of the housing 101.

FIG. 3 shows an embodiment of the invention in which the bottom 238 of the tank is formed directly with a thread 238a into which the threaded shank 52a of the partition structure 233 is screwed.

The valve elements 42, 45, 47 etc., of this embodiment are identical to those of FIG. 2 and hence need not be further described. In this embodiment, however, the partition structure 233 forms a pot-shaped housing for the valve, the housing having a head 52 adapted to clamp a seal 54 against the shoulder 238b of the lighter wall. An internally threaded sleeve 47a is here embedded in the molded partition structure 233 to receive the sleeve 47 as previously described. The frustoconical tip 53 of the pot-shaped partition structure 233 is provided with three passages 37, 37a and 37b which permit passage of the fuel into the tank of the lighter. A bore 51 in the flange or head 52 permits a pin to be inserted to enable the entire structure 233 to be screwed into the wall 238. The bores or passages 37, 37*a* and 37*b* have diameters of 0.3 mm so that the three bores together have approximately the preferred cross section of a single passage of a diameter of 0.5 mm. The upwardly converging and downwardly diverging shape of the tip of the partition prevent foreign bodies from collecting thereon, while the rounded configuration (i.e. rotationally symmetric configuration with a longitudinal axis of symmetry) prevents foreign matter from collecting on the partition in all positions thereof. Foreign matter thus does not reach the sealing surface.

I claim:

1. In a fuel container provided with a valve for filling said container from a filling tank, said valve comprising a valve member with a sealing surface biased against a seat by a spring, the improvement which comprises a partition surrounding said sealing surface and said seat and separating same from the interior of said container, said partition being elongated and projecting into the interior of said container, and at least one passage with a diameter between 0.2 and 0.8 mm formed in said partition for enabling fuel to pass from said valve into the interior of said container, said valve being disposed within said partition, said partition having a generally conical tip with one such passage being provided at the apex of said tip, said tip and said passage being dimensioned to admit fuel from said valve to the interior of said container while preventing contaminants from entering said partition.

2. The improvement defined in claim 1 wherein said partition is formed in one piece with a wall of said container.

3. The improvement defined in claim 1 wherein said partition is bonded to a wall of said container.

4. The improvement defined in claim 1 wherein said partition is threaded into a wall of said container.

5. The improvement defined in claim 1 wherein said partition forms a valve housing receiving said valve member, said seat and a spring biasing said valve member against said seat.

6. The improvement defined in claim 1 wherein the partition has a single passage of a diameter of 0.5 mm.

7. The improvement defined in claim 1 wherein said partition is formed with a plurality of passages each having a diameter less than 0.5 mm.

8. The improvement defined in claim 1 wherein said container receives a wick extending therein, and an envelope of an adsorption agent in said container for removing oils and fat from fuel contained therein.

9. The improvement defined in claim 8 wherein said partition is a generally cylindrical hollow body projecting into said container from a bottom wall thereof, said valve being formed with a coil spring seated against said tip and bearing downwardly on said valve member, said valve member having an annular flange provided with a sealing ring bearing upon said seat, and a stem extending through said seat.

* * * * *